US008718493B2

(12) United States Patent
Nagata

(10) Patent No.: US 8,718,493 B2
(45) Date of Patent: May 6, 2014

(54) APPARATUS AND METHOD OF CONTROLLING AN IMAGE FORMING APPARATUS

(75) Inventor: Hiroaki Nagata, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 282 days.

(21) Appl. No.: 13/150,536

(22) Filed: Jun. 1, 2011

(65) Prior Publication Data

US 2011/0311241 A1 Dec. 22, 2011

(30) Foreign Application Priority Data

Jun. 16, 2010 (JP) ..... 2010-137399

(51) Int. Cl.

| | |
|---|---|
| ***G03G 15/00*** | (2006.01) |
| ***G03G 21/00*** | (2006.01) |
| ***B65H 7/02*** | (2006.01) |
| ***B41J 29/38*** | (2006.01) |

(52) U.S. Cl.
USPC ..... 399/21; 399/70; 271/176; 400/625

(58) Field of Classification Search
USPC ..... 399/21
See application file for complete search history.

(56) References Cited

U.S. PATENT DOCUMENTS

| | | | | | |
|---|---|---|---|---|---|
| 5,033,731 | A * | 7/1991 | Looney | ..... | 271/176 |
| 5,653,846 | A * | 8/1997 | Onodera et al. | ..... | 156/362 |
| 5,957,446 | A * | 9/1999 | Takanuma | ..... | 271/9.09 |
| 6,153,888 | A * | 11/2000 | Fournier et al. | ..... | 250/559.4 |
| 2005/0122063 | A1 * | 6/2005 | Lee | ..... | 315/291 |
| 2006/0171754 | A1 * | 8/2006 | Takami et al. | ..... | 400/76 |

FOREIGN PATENT DOCUMENTS

| | | | | | |
|---|---|---|---|---|---|
| JP | 04323166 | A * | 11/1992 | ..... | G03G 15/00 |
| JP | 08030138 | A * | 2/1996 | ..... | G03G 15/20 |
| JP | 11021001 | A * | 1/1999 | ..... | B65H 26/02 |
| JP | 2003233276 | A * | 8/2003 | ..... | B41J 29/38 |
| JP | 2004170457 | A * | 6/2004 | ..... | G03G 21/00 |
| JP | 2004-248047 | | 9/2004 | | |
| JP | 2004248047 | A * | 9/2004 | ..... | G03G 21/00 |

* cited by examiner

*Primary Examiner* — Nguyen Ha
(74) *Attorney, Agent, or Firm* — Oblon, Spivak, McClelland, Maier & Neustadt, L.L.P.

(57) ABSTRACT

A controller for controlling an image forming apparatus having a light detection unit controls at least two operations including: 1) operation of detecting a jam of a recording sheet in a sheet transfer path based on a light intensity level detected by the light detection unit when image forming is performed; and 2) operation of controlling switching of an operation mode of the image forming apparatus to an energy save mode based on a light intensity level detected by the light detection unit.

16 Claims, 6 Drawing Sheets

APPARATUS AND METHOD OF CONTROLLING AN IMAGE FORMING APPARATUS

CROSS-REFERENCE TO RELATED APPLICATIONS

This patent application is based on and claims priority under 35 U.S.C. §119 to Japanese Patent Application No. 2010-137399, filed on Jun. 16, 2010, in the Japanese Patent Office, the entire disclosure of which is hereby incorporated herein by reference.

FIELD OF THE INVENTION

The present invention generally relates to an apparatus and a method of controlling an image forming apparatus, and more specifically to an apparatus and a method of controlling switching an operation mode of the image forming apparatus.

BACKGROUND

Recent image forming apparatuses sometimes operate in an energy save mode in which energy consumption is reduced, for example, by stopping electric supply to devices that are not currently in use. Japanese Patent Application Publication No. 2004-248047 describes an image forming apparatus provided with a light sensor capable of detecting the intensity of ambient light. When the light intensity detected by the light sensor is below a predetermined value, the image forming apparatus operates in the energy save mode. When the light intensity detected by the light sensor reaches the predetermined value, the image forming apparatus is switched from the energy save mode to a waiting mode. In this manner, energy consumption can be reduced when the room is dark such as when nobody is in the office. Further, as the image forming apparatus is switched to the waiting mode when the room becomes lighter, the image forming apparatus starts warming up to prepare for image forming operation.

SUMMARY

While the image forming apparatus of Japanese Patent Application Publication No. 2004-248047 is user friendly as it automatically switches the operation mode based on the environment lighting conditions, providing the light sensor in addition to many sensors that are already installed in the image forming apparatus would further increase the number of parts as well as increase the overall manufacturing costs.

In order to solve this problem, the inventor of the present invention has discovered that one of the sensors that are already installed in the image forming apparatus can be used as a light sensor. For example, a discharge sheet sensor, which is usually provided in a sheet discharge section to detect a jam, can be additionally provided with a function of detecting the intensity of ambient light, thus reducing the total number of parts and the overall manufacturing costs.

Example embodiments of the present invention include an apparatus, method, system, computer program and product each capable of controlling at least two operations including: 1) operation of detecting a jam of a recording sheet in a sheet transfer path based on a light intensity level detected by detecting means when image forming is performed; and 2) operation of controlling switching of an operation mode of the image forming apparatus to an energy save mode based on a light intensity level detected by the detecting means. The detecting means may be a light sensor capable of performing a function of jam detection and a function of detecting ambient light.

In addition to the above-described example embodiments, the present invention may be practiced in various other ways.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
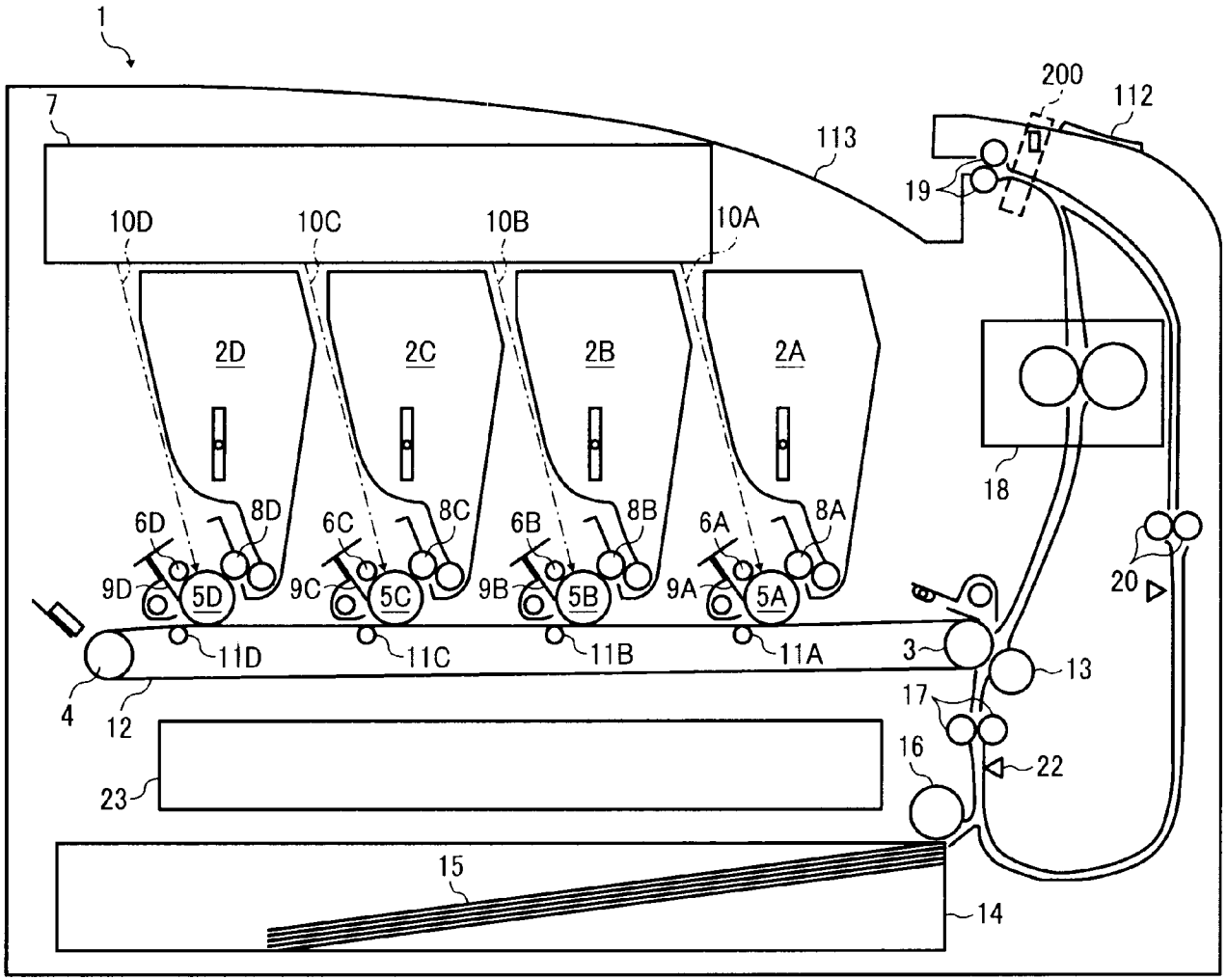
FIG. 1 is a cross-sectional view illustrating a hardware structure of an image forming apparatus, according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring now to FIG. 1, a structure of an image forming apparatus 1 is explained according to an example embodiment of the present invention. The image forming apparatus 1 includes four image forming units 2A, 2B, 2C, and 2D, which are arranged side by side above an intermediate transfer belt 12. The intermediate transfer belt 12 is an endless belt, which is wound around a plurality of rollers including a secondary transfer drive roller 3, a transfer belt tension roller 4, and transfer rollers 11A, 11B, 11C, and 11D. The intermediate transfer belt 12 is rotated in the counterclockwise direction as the drive roller 3 rotates.

In this example, the image forming units 2A, 2B, 2C, and 2D, which may be collectively referred to as the image forming unit 2, are implemented by process cartridges for respective colors of black, cyan, magenta, and yellow. The image forming unit 2 includes a photoconductor 5, a charger 6, a developer 8, and a cleaner 9. Above the image forming units 2, an exposure device 7 is provided, which irradiates light beams 10A, 10B, 10C, and 10D, respectively toward the surfaces of photoconductors 5 of the image forming units 2.

The image forming apparatus 1 further includes a sheet feed tray 14, a sheet feed roller 16, a registration roller pair 17, a registration sensor 22, a sheet discharge roller pair 19, a switch back roller pair 20, a secondary transfer roller 13, a fixing device 18, a light detection unit 200, and a toner collection container 23.

In image forming operation, the charger 6 uniformly charges the surface of the photoconductor 5. The exposure device 7 irradiates the light beam 10 onto the surface of the photoconductor 5 to form a latent image thereon. The developer 8, which is supplied with toner from a toner container, develops the latent image into toner image. The toner image formed on the surface of the photoconductor 5 is transferred onto the surface of the intermediate transfer belt 12 at a primary transfer position. The primary transfer position is where the photoconductor 5 and the intermediate transfer belt 12 are made in close contact with each other. For example, the photoconductor 5 and the transfer roller 11 are made in close contact with each other via the intermediate transfer belt 12 to form a nip, which functions as the primary transfer position. The cleaner 9, which may be implemented by a cleaning blade, removes residual toner from the surface of the photoconductor 5 after the toner image is transferred. The toner removed from the surface of the photoconductor 5 is conveyed to the toner collection container 23.

By repeating the above-described image forming operation for respective colors of black, cyan, magenta, and yellow, the intermediate transfer belt 12 is formed with a full-color image, which is generated by superimposing toner images of the respective colors one above the other. The intermediate transfer belt 12 having the full-color image thereon is further conveyed to a secondary transfer position at which the drive roller 3 and the secondary transfer roller 13 are made in contact with each other.

The sheet feed tray 14 stores therein a stack of recording sheets 15. The sheet feed roller 16 feeds the recording sheets 15 from the sheet feed tray 14, sheet by sheet, toward the registration roller pair 17. The registration roller pair 17 starts rotating at a predetermined timing such that the recording sheet 15 is conveyed to the secondary transfer position to receive the full-color toner image carried by the intermediate transfer belt 12. At the secondary transfer position, the full-color toner image is transferred from the intermediate transfer belt 12 onto the recording sheet 15. The recording sheet 15 having the full-color toner image thereon is conveyed to the fixing device 18. At the fixing device 18, the toner image is fixed onto the recording sheet 15 by heat and pressure.

In case of single-sided printing, the recording sheet 15 is further conveyed to the sheet discharge roller pair 19 through the light detection unit 200, and output onto a sheet discharge tray 113 that is provided on the top surface of the image forming apparatus 1.

In case of double-sided printing, when the recording sheet 15 reaches the discharge roller pair 19, the discharge roller pair 19 is rotated in the opposite direction to transfer the recording sheet 15 back toward the switch back roller pair 20. The recording sheet 15 is transferred through the switch back roller pair 20 to the registration roller pair 17. The recoding sheet 15 is further conveyed toward the secondary transfer position to receive a full-color toner image on the other side of the recording sheet 15. The recording sheet 15 having the full-color toner images on both sides of sheet is conveyed through the fixing device 18, and is output through the sheet discharge roller pair 19 onto the sheet discharge tray 113.

The image forming apparatus 1 is further provided with an operation panel 112, which functions as an input device that allows a user to input a user instruction and a display device that displays various information to the user. For example, when the operation panel 112 receives a user instruction for printing, the image forming apparatus 1 performs image forming operation. Alternatively, the image forming apparatus 1 may receive a user instruction for printing from the outside apparatus such as a host computer. In this example, the display device is implemented by a liquid crystal display (LCD), but any other type of display device may be provided.

Figure 2:
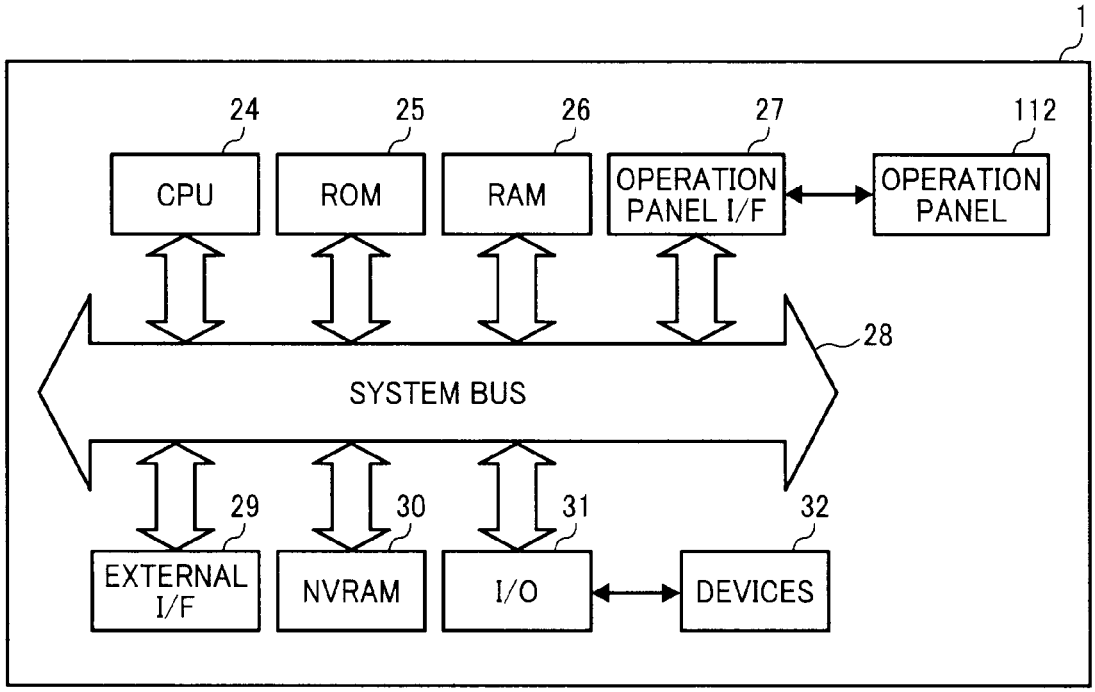
FIG. 2 is a schematic block diagram illustrating a structure of a controller section of the image forming apparatus of FIG. 1.

The image forming apparatus 1 is further provided with a control section, which controls entire operation of the image forming apparatus 1. As illustrated in FIG. 2, the control section of the image forming apparatus 1 includes a central processing unit (CPU) 24, a read only memory (ROM) 25, a random access memory (RAM) 26, an operation panel interface (I/F) 27, an external interface (I/F) 29, a nonvolatile RAM (NVRAM) 30, and an input/output (IO) device 31, which are connected through a system bus 28.

The CPU 24 controls operation of the image forming apparatus 1, for example, by controlling devices through the system bus 28. The ROM 25 stores therein various control programs. The RAM 26 functions as a work memory for the CPU 24, an area for deploying image data, or an area for storing various data. The memory space of the RAM 26 is extendable by an option RAM that may be connected to ports of the image forming apparatus 1. The operation panel I/F 27, which is coupled to the operation panel 112, sends a user instruction received through the operation panel 112 to the CPU 24 or sends various information received from the CPU 24 through the operation panel 112. The external I/F 29 allows the CPU 24 to communicate with an external device such as a host computer. The NVRAM 30 may store settings data such as settings data regarding operation modes, which may be received through the operation panel I/F 27. The I/O 31 allows the CPU 24 to control various devices 32 in the image forming apparatus 1. The various devices 32 include, for example, sensors, motors, clutches, and heaters.

As described below, the control section of the image forming apparatus 1 controls operation of switching an operation mode of the image forming apparatus 1. The image forming apparatus 1 operates in a plurality of operation modes including a printing mode in which image forming operation is performed, a waiting mode in which the image forming apparatus 1 waits for user instruction, and an energy save mode in which energy consumption is reduced. For example, when a user instruction for printing is received while the image forming apparatus 1 is in the waiting mode or the energy save mode, the CPU 24 changes the value of a printing flag to ON while changing the value of a waiting flag or an energy save flag to OFF to indicate that the operation mode is switched to the printing mode. When printing is completed, the CPU 24 changes the value of the waiting flag to ON while changing the value of the printing flag to OFF to indicate that the operation mode is switched from the printing mode to the waiting mode. When the CPU 24 determines that no user instruction is received for a predetermined time period after switching to the waiting mode, the CPU 24 changes the value of the energy save mode to ON while changing the value of the waiting flag to OFF to indicate that the operation mode is switched from the waiting mode to the energy save mode. Further, in this example, the CPU 24 is capable of automatically switching between the waiting mode and the energy save mode based on environment lighting conditions, based on a detection result output by the light detection unit 200.

In this example, the light detection unit 200 is provided with at least two functions including a function of detecting a sheet jam, and a function of detecting the intensity of ambient light. More specifically, the light detection unit 200 is provided with a sensor capable of detecting whether the recording sheet is successfully transferred and detecting the environment lighting conditions. Since the known sheet discharge sensor detects whether the recording sheet is transferred or not based on ON or OFF of the sensor, simply causing the sheet discharge sensor to function as a light sensor that detects light or dark based on ON or OFF of the sensor would not work, as the sheet discharge sensor cannot determine whether ON or OFF state of the sensor is caused by whether the recording sheet passes through the sensor or the environmental lighting condition change.

In view of the above, the CPU 24 of the image forming apparatus 1 performs operation of controlling the light detection unit 200 such that the light detection unit 200 can have at least the function of detecting a sheet jam and the function of detecting the intensity of ambient light.

Figure 3:
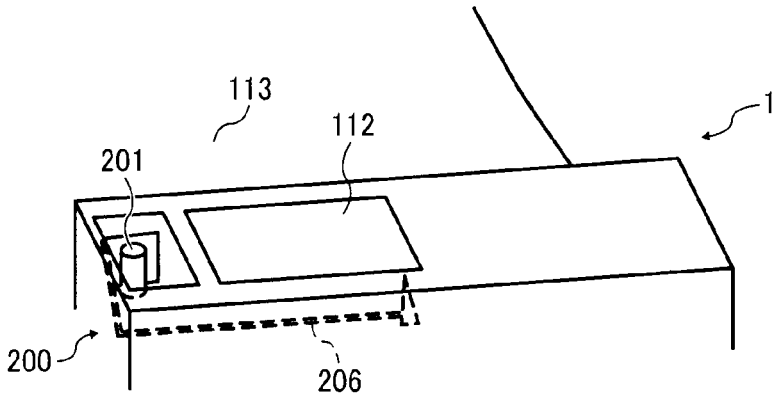
FIG. 3 is a perspective view illustrating a portion of the image forming apparatus of FIG. 1 in which a light detection unit is provided.

More specifically, the light detection unit 200 is configured to have a hardware structure that allows the light detection unit 200 to have at least the function of detecting a sheet jam and the function of detecting the intensity of ambient light. For example, as illustrated in FIG. 3, the light detection unit 200 includes a sensor 201 and a filler 206, which together operate as described below. Further, the control section of the image forming apparatus 1 is provided with at least the function of controlling sheet jam detection and the function of controlling switching of an operation mode, based on the detection result of the light detection unit 200.

Figure 4:
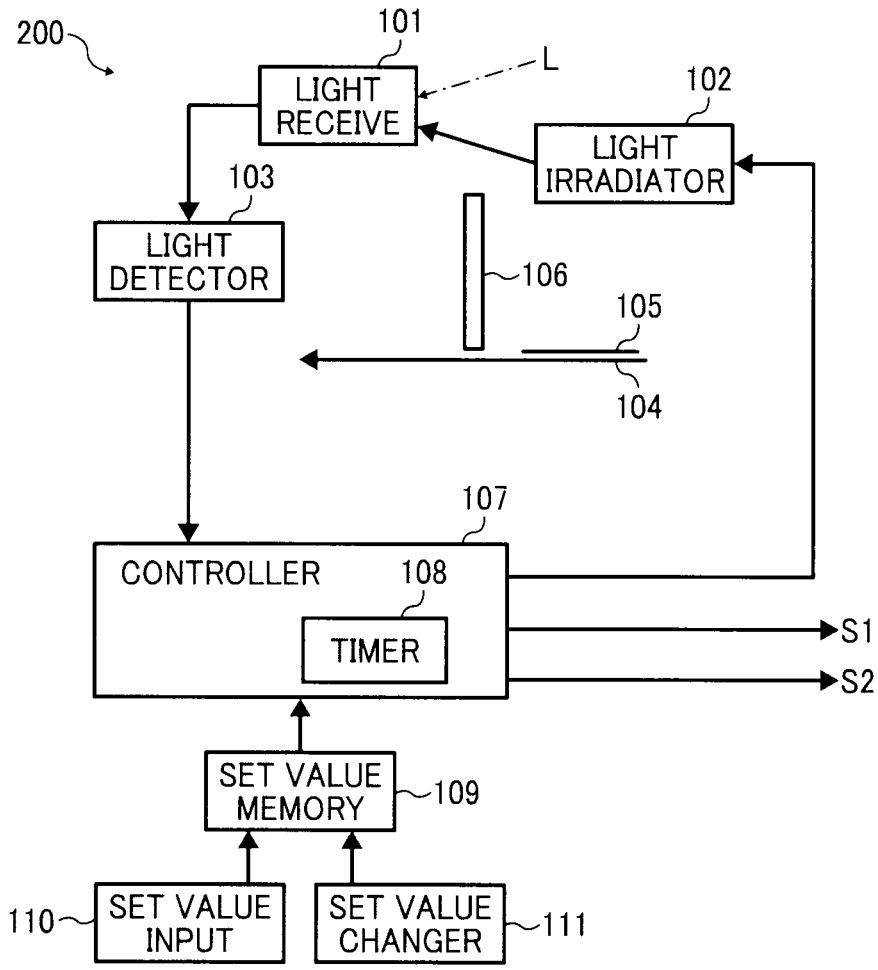
FIG. 4 is a schematic block diagram illustrating a functional structure of the light detection unit of FIG. 3.

Referring now to FIG. 4, a functional structure of the light detection unit 200 is explained according to an example embodiment of the present invention. For example, the ROM 25 stores a control program for controlling operation of sheet jam detection and operation of switching of the operation mode based on the detection result of the light detection unit 200. Upon execution of the control program, the CPU 24 of FIG. 2 causes various devices of the image forming apparatus 1 to function as the light detection unit 200 shown in FIG. 4.

The light detection unit 200 includes a light receive 101, a light irradiator 102, a light level detector ("light detector") 103, a light preventer 106, a controller 107, a set value memory 109, a set value input 110, and a set value changer 111. In FIG. 4, 104 denotes a path through which the recording sheet 15 is conveyed, and is provided between the fixing device 18 and the sheet discharge roller pair 19.

The light receive 101 detects whether light is received, and outputs a detection result to the light level detector 103. In this example, the light receive 101 is implemented by a light sensor 201, such as a photo-interrupter light sensor, which has the functions of detecting a sheet jam and detecting the intensity of ambient light. As illustrated in FIG. 4, the light receive 101 detects ambient light L, which enters into the inside of the image forming apparatus 1 from the outside. Further, the light receive 101 detects light irradiated by the light irradiator 102. In this example, the light irradiator 102 is a backlight of a liquid crystal display (LCD) provided in the operation panel 112.

The light level detector 103 obtains the light intensity level of the light received by the light receive 101 from the detection result, and sends information regarding the light intensity level of the detected light to the controller 107. The function of the light level detector 103 is provided by the light sensor 201. In this example, the light intensity level is expressed in luminance, which is the light intensity level per unit time. For simplicity, the light intensity level and the light level may be used exchangeably.

The path 104 is a path through which the recording sheet 15 is transferred, and is provided between the fixing device 18 and the sheet discharge roller pair 19. Along the path 104, any desired number of sheet feed rollers or transfer rollers, or an endless belt, may be provided.

The light preventer 106 prevents or suppresses the light receive 101 from receiving light when the recording sheet 15 passes through the path 104. In this example, the light preventer 106 is implemented by the filler 206 of FIG. 3. In order to detect a jam, the filler 206 is provided at a predetermined position in the path 104, preferably, at a position near the sheet discharge roller pair 19 at which the recording sheet 15 is discharged onto the discharge tray 113. As the recording sheet 15 is transferred, the filler 206 is rotated so as to prevent or suppress the light receive 101 from receiving the light L and the light irradiated by the light irradiator 102.

The controller 107 controls at least two operations including a first operation of detecting a jam, and a second operation of switching the operation mode, based on the light level output by the light detector 103. The controller 107 may be implemented by the CPU 24, which controls sheet jam detection operation and operation mode switching operation according to a control program stored in any desired memory such as the ROM 25. The controller 107 is provided with a timer 108 that counts a time period to obtain a timer value. For example, as illustrated in FIG. 4, the controller 107 may output a signal S1 for controlling jam detection operation, and a signal S2 for controlling operation mode switching operation.

The set value memory 109 stores various settings data including, for example, a first reference light intensity level and a second reference light intensity level that are used for sheet jam detection, and a third reference light intensity level used for controlling switching of the operation mode.

The set value memory 109 may be implemented by non-volatile memory such as a semiconductor memory or the NVRAM 30. The set value memory 109 further stores information indicating whether to automatically switch the operation mode to the energy save mode based on the detected light intensity. The controller 107 refers to this settings data, which may be referred to as the option, stored in the set value memory 109 to determine whether to control operation of switching the operation mode based on the environment lighting conditions.

The set value input 110 allows the user to select whether to automatically switch the operation mode to the energy save mode based on the detected light intensity of the light detection unit 200. The set value changer 111 changes various settings data stored in the set value memory 109 based on a user instruction. The set value input 110 and the set value changer 111 may be each or collectively implemented by a control program that operates with the operation panel 112 or hardware resources of a computer connected to the image forming apparatus 100, thus providing a user interface function for allowing the user to input or change settings data.

Figure 5:
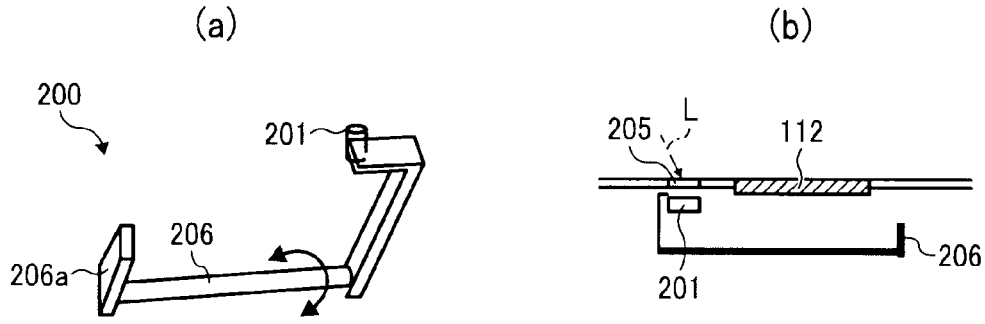
FIG. 5 is an illustration for explaining operation of the light detection unit when a recording sheet is not transferred through a path where the light detection unit is provided.
Figure 6:
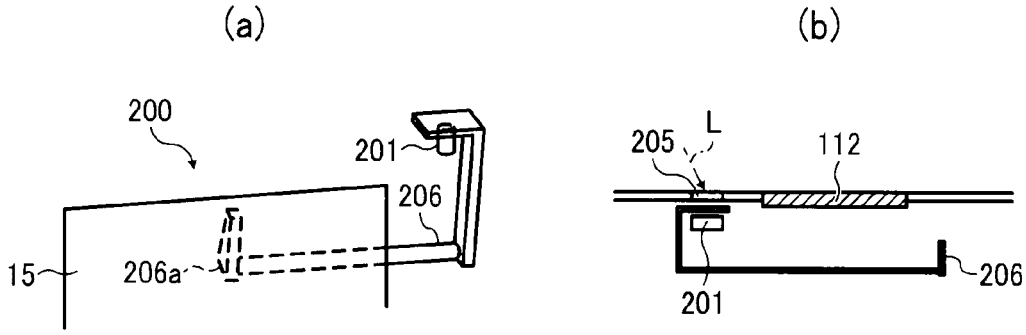
FIG. 6 is an illustration for explaining operation of the light detection unit when the recording sheet is transferred through the path where the light detection unit is provided.

Referring now to FIGS. 5 and 6, operation of the light detection unit 200 is explained. As described above referring to FIGS. 3 and 4, the light detection unit 200 includes the light sensor 201 functioning as the light receive 101, and the filler 206 functioning as the light preventer 106. The light irradiator 102 of FIG. 4 is implemented by a backlight of the LCD of the operation panel 112. FIG. 5 illustrates the light detection unit 200 when the recording sheet 15 is not transferred through the path 104 where the light detection unit 200 is provided. FIG. 6 illustrates the light detection unit 200 when the recording sheet 15 is transferred through the path 104 where the light detection unit 200 is provided.

Referring to FIG. 5, the light sensor 201 is provided such that its upper side surface, which functions as the light receive 101, faces upward. Since the upper side surface of the light sensor 201 faces upward, the light sensor 201 is able to receive ambient light L from the outside through a window 205. In this example, the window 205, which is provided right above the light sensor 201, is made of transparent material such as plastics to allow transmittance of ambient light. Alternatively, a slit may be provided at a predetermined position of the outer side surface of the image forming apparatus 100 to allow the ambient light to enter into the light sensor 201.

Further, the light sensor 201 is provided at a position near the operation panel 112 such that the light sensor 201 is able to receive light from the backlight of the LCD of the operation panel 112.

The filler 206 is provided at a predetermined position in the path 104. The filler 206 has a convex section 206*a*, a shaft section that rotates in the direction shown in FIG. 5, and a cover section having a hook shape. As illustrated in FIG. 5, when there is no recording sheet 15 passing through the path 104, the light sensor 201 is not covered with the cover section of the filler 206.

Referring to FIG. 6, when the recording sheet 15 is transferred through the path 104 where the light detection unit 200 is provided, the leading edge of the recording sheet 15 presses the convex section 206*a* of the filler 206 to cause the shaft section of the filler 206 to rotate. With the rotation, the cover section of the filler 206 is moved so as to cover the upper surface of the light sensor 201. Since the upper surface of the light sensor 201, which functions as the light receive 101, is covered, the intensity of the light that can be detected by the light sensor 201 is reduced. Based on this change in light intensity level, the controller 107 determines whether the recording sheet 15 passes through the path 104.

As illustrated in FIG. 6, when the recording sheet 15 passes, the filler 206 is rotated to cover the upper surface of the light sensor 201 to prevent or suppress the light sensor 201 from receiving light. Alternatively, the light detection unit 200 may be configured to have a structure such that the recording sheet 105 covers the upper surface of the light sensor 201 while passing through the light detection unit 200.

The CPU 24 functioning as the controller 107 receives the light intensity level detected by the light sensor 201, and compares the detected light intensity level with one of the reference levels stored in the set value memory 109 to determine whether a jam is detected or whether to switch the operation mode.

For example, the first reference level, which may be referred to as a sheet transfer reference level, is used to determine whether the recording sheet is passing through the path 104 where the light detection unit 200 is provided. When the light intensity level detected by the light sensor 201 functioning as the light receive 101 is less than the sheet transfer reference level, the CPU 24 determines that the recording sheet is passing through the path 104. As illustrated in FIG. 6, when the recording sheet 15 is transferred through the path 104 where the light detection unit 200 is provided, the shaft of the filler 206 is rotated to cause the cover section of the filler 206 to cover the upper surface of the light sensor 201 such that the detected light intensity level is reduced.

The second reference level, which may be referred to as a start reference level, is used to determine whether the light detection unit 200 is capable of detecting a jam, i.e., image forming operation can be performed. When the light intensity level detected by the light sensor 201 is equal to or greater than the start reference level, the CPU 24 determines that jam detection can be performed, i.e., image forming operation can be performed. More specifically, when the detected light intensity level is equal to or greater than the start reference level, the CPU 24 determines that it is capable of determining whether the recording sheet 15 is passing through the path 104 based on the detection result of the light sensor 201.

The start reference level is set in order to prevent an error in jam detection. For example, when the detected light intensity level is slightly larger than the sheet transfer reference level at the time of starting printing operation, the CPU 24 may determine that the recording sheet 15 is passing through the path 104 as long as the light intensity level becomes less than the sheet transfer reference level even when the recording sheet 15 is not actually passing through the path 104. For example, the detected light intensity level may be low when the ambient light level is low, when backlight of the operation panel 112 is turned off or irradiates less light, for example, to reduce energy consumption. In case the ambient light level is sufficiently high, i.e., the detected light intensity level is sufficiently high, the light intensity level of the backlight of the operation panel 112 does not have to be increased as the light sensor 201 is able to perform jam detection without causing an error, based on the difference between the light intensity level detected when the light sensor 201 is covered and the light intensity level detected when the light sensor 201 is not covered. In this example, the start reference level is set to be greater than the sheet transfer reference level. By setting the start reference level to be greater than the sheet transfer reference level, detection error that may be caused when the detected light intensity level is too low at the start of image forming operation can be suppressed.

The sheet transfer reference level is previously set based on parameters of the light sensor 201. The start reference level is previously set depending on parameters of the light sensor 201 and the backlight of the operation panel 112, such as the light intensity of the backlight and the positions where the light sensor 202 and the operation panel 112 are respectively provided. In order to set the reference levels, the light intensity level detected by the light sensor 201 when the light sensor 201 is covered with the cover section of the filler 206, and the light intensity level detected by the light sensor 201 when the backlight of the operation panel 112 is set at the maximum level are respectively obtained. The sheet transfer reference level is set to be a value greater than the light intensity level detected when the light sensor 201 is covered, and less than the start reference level. The start reference level is set to be a value larger than the sheet transfer reference level, and less than the light intensity level detected when the backlight is set to maximum.

In addition to the first and second reference levels, the set value memory 109 may further store the third reference level, which may be referred to as an energy save reference level, to be used for controlling switching of the operation mode to the energy save mode. When the light intensity level detected by the light sensor 201 is less than the energy save reference level, the CPU 24 functioning as the controller 107 determines that the operation mode is switched to the energy save mode based on the assumption that a room where the image forming apparatus 1 is provided is dark. For example, the energy save reference level may be set based on the light intensity level detected by the light sensor 201 when the backlight of the operation panel 112 is turned off.

Figure 7:
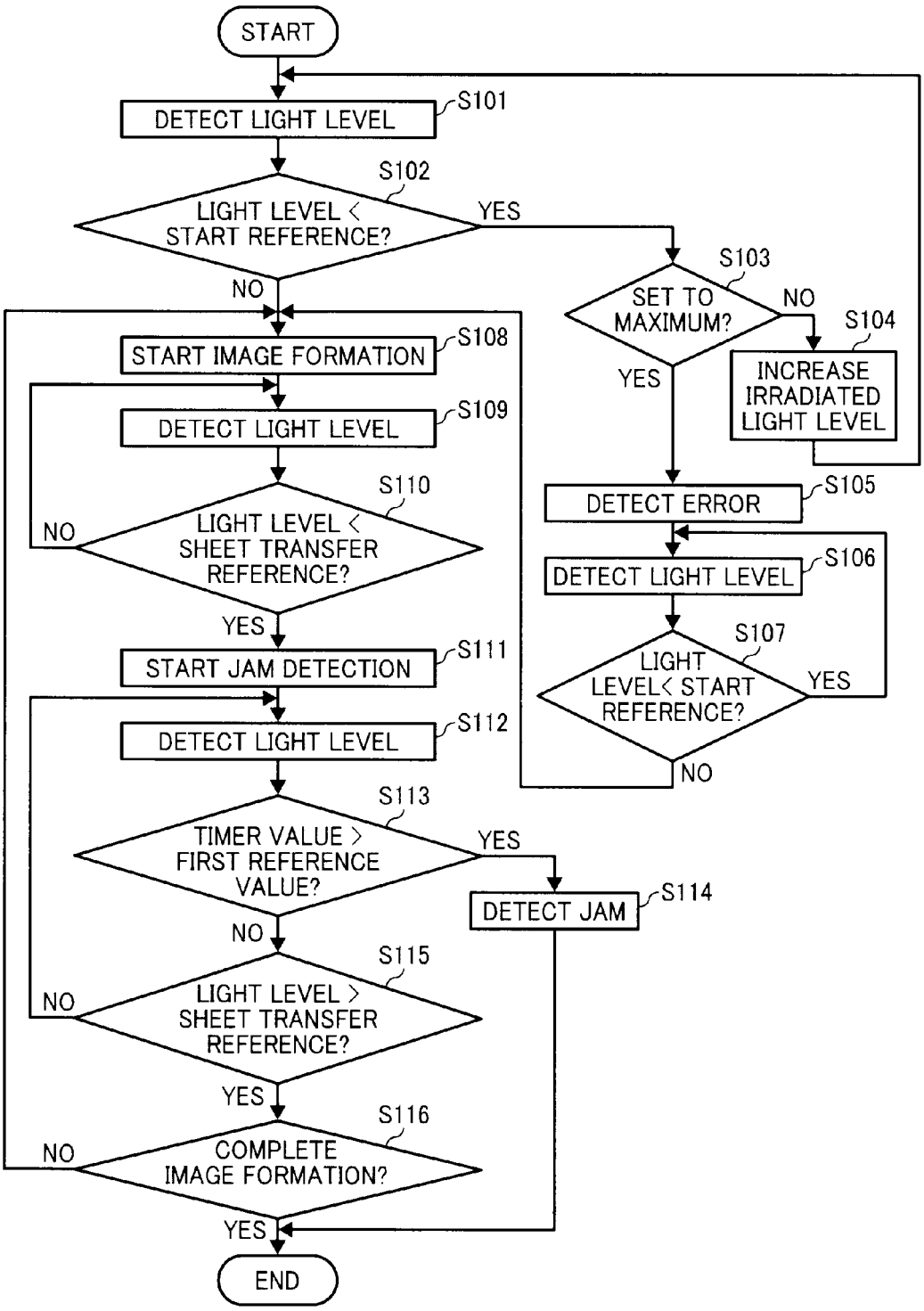
FIG. 7 is a flowchart illustrating operation of detecting a jam, performed by the image forming apparatus of FIG. 1, according to an example embodiment of the present invention.
Figure 8:
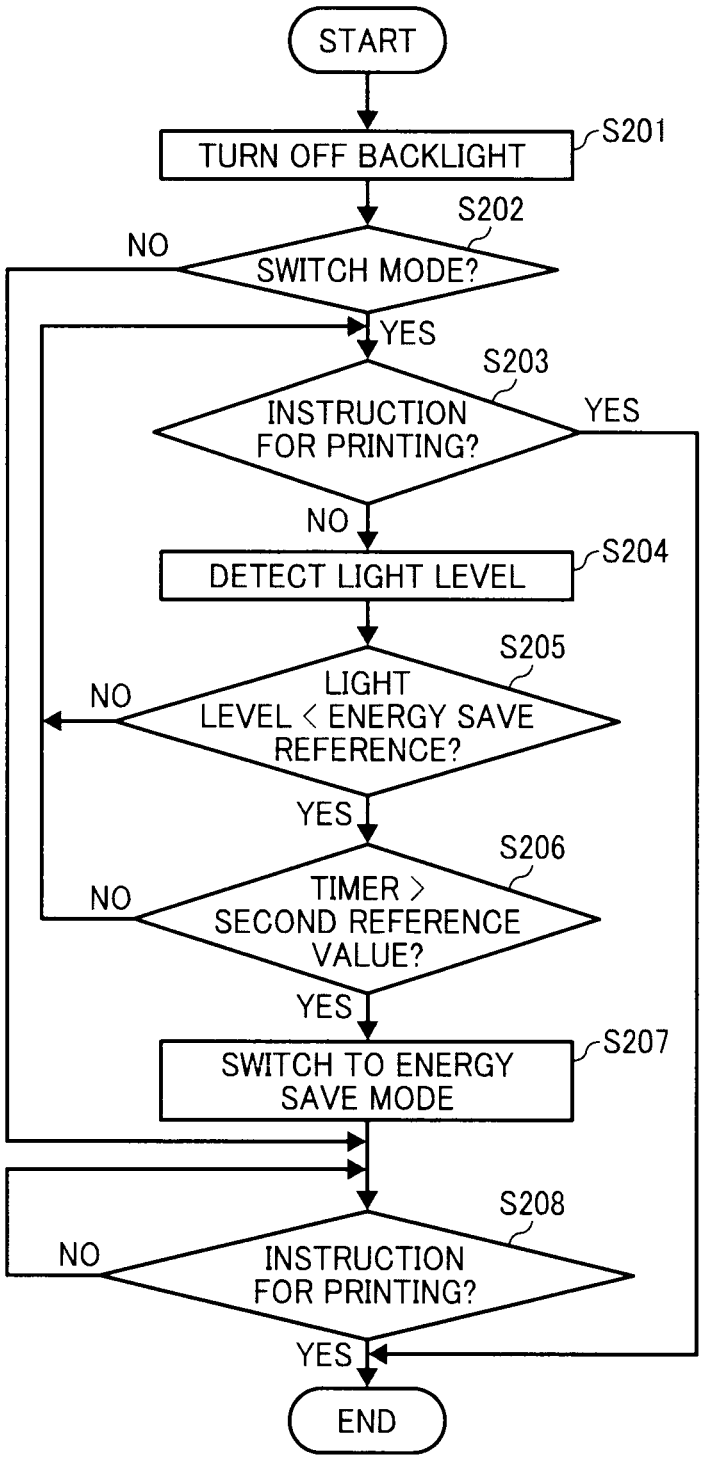
FIG. 8 is a flowchart illustrating operation of switching the operation mode of the image forming apparatus, performed by the image forming apparatus of FIG. 1, according to an example embodiment of the present invention.

Referring now to FIG. 7, operation of detecting a jam, performed by the controller 107, is explained according to an example embodiment of the present invention. The operation of FIG. 8 is performed when the CPU 24 functioning as the controller 107 receives a user instruction for performing image formation such as printing operation, for example, through the operation panel 112.

At S101, the controller 107 causes the light sensor 201 to detect light such as ambient light L and light received from the backlight of the operation panel 112 to output a detection result indicating the light intensity level of the detected light.

At S102, the controller 107 determines whether the light intensity level detected by the light sensor 201 is less than a start reference level. When it is determined that the light intensity level is equal to or greater than the start reference level ("NO" at S102), the operation proceeds to S108.

When it is determined that the light intensity level is less than the start reference level ("YES" at S102), the operation proceeds to S103. When the light intensity level is less than the start reference level, the controller 107 is not able to determine whether the recording sheet 15 is transferred through the path 104 based on the detection result of the light sensor 201 as the light intensity level of the light sensor 201 does not change much compared to the light intensity level that can be obtained when the recording sheet 15 does not pass through the path 104. For this reason, the controller 107 causes the backlight of the operation panel 112 to increase its level of irradiated light, thus increasing the light intensity level to be detected by the light sensor 201 before starting jam detection to increase the difference between the light level detected when the light sensor 201 is not covered and the light level detected when the light sensor 201 is covered.

At S103, the controller 107 determines whether a light intensity level of the light irradiated by the backlight of the operation panel 112 is set to the maximum level. When it is determined that the irradiated light level of the backlight is not set to the maximum level ("NO" at S103), the operation proceeds to S104.

At S104, the controller 107 increases the irradiated light of the backlight of the operation panel 112 by a predetermined value, and the operation proceeds to S101 to detect a light intensity level using the light sensor 201 to determine whether the detected light intensity level is less than the start reference level. Since the light intensity level of the backlight is gradually increased until it reaches the start reference level, the light detection unit 200 is able to proceed to perform the sheet jam detection with the minimum level of the light intensity that is sufficient to start image forming operation, thus lowering energy consumption.

When it is determined that the irradiated light level of the backlight is set to the maximum level at S103 ("YES" at S103), the operation proceeds to S105 to determine that the light sensor 201 is covered by, for example, a foreign object, and notifies the user that an error is detected. For example, the controller 107 may cause the operation panel 112 to display a message indicating that an error is detected. Since the light sensor 201 is provided at the position where the light sensor 201 can receive light from the backlight, and the filler 206 does not cover the light sensor 201 when the recording sheet 15 is not transferred, the detected light intensity level of the light sensor 201 should be equal to or greater than the start reference level when the backlight is set to the maximum level. Based on this assumption, if the detected light intensity level of the light sensor 201 is less than the start reference level when the backlight is set to the maximum level, the controller 107 determines that the light sensor 201 is covered by a foreign object other than the filler 206.

At S106, the light sensor 201 detects a light intensity level in a substantially similar manner as described above referring to S101.

At S107, the controller 107 determines whether the light intensity level detected by the light sensor 201 at S106 is less than the start reference level. When it is determined that the light intensity level is less than the start reference level ("YES" at S107), the operation returns to S106. By repeating the operation of S106 and S107, the controller 107 determines whether the light sensor 201 is covered or not by a foreign object and continues to output notification to the user. When the detected light intensity level becomes equal to or greater than the start reference level ("NO" at S107), the controller 107 determines that the object that has been covering the light sensor 201 is removed, and the operation proceeds to S108.

At S108, the controller 107 determines that the light sensor 201 is capable of detecting a jam, and starts image forming operation.

At S109, the controller 17 detects the light intensity level of the light received by the light sensor 201.

At S110, the controller 17 determines whether the detected light intensity level obtained at S109 is less than the sheet transfer reference level. When it is determined that the detected light intensity level is equal to or greater than the sheet transfer reference level ("NO" at S110), the operation returns to S109. When it is determined that the detected light intensity level is less than the sheet transfer reference level ("YES" at S109), the controller 107 determines that the recording sheet 15 is passing through the path 104 where the light detection unit 200 is provided, and the operation proceeds to S111.

At S111, the controller 107 causes the timer 108 to start counting a time period to output a timer value. The timer value is used to determine whether a sheet jam is detected.

At S112, the light sensor 201 detects the light intensity level of the light received by the light sensor 201 to determine whether the recording sheet 15 has passed through the path 104 toward the sheet discharge roller pair 19.

At S113, the controller 107 determines whether the timer value obtained by the timer 108 reaches a first reference timer value. When it is determined that the timer value exceeds the first reference timer value ("YES" at S113), the controller 107 determines that a jam is detected, and the operation proceeds to S114. In this example, the first reference timer value is previously set to indicate whether the recording sheet 15 successfully passes the path 104. The first reference timer value may be set differently, depending on the size of the recording sheet.

At S114, the controller 107 notifies the user that a jam is detected. For example, the controller 107 may cause the operation panel 112 to display an error message.

When it is determined that the timer value is equal to or less than the first reference timer value ("NO" at S113), the operation proceeds to S115. At S115, the controller 107 determines whether the detected light intensity level obtained at S112 is greater than the sheet transfer reference level. When it is determined that the detected light intensity level is equal to or less than the sheet transfer reference level ("NO" at S115), the controller 107 determines that the recording sheet 15 is passing through the path 104, and the operation proceeds to S112. When it is determined that the detected light intensity level is greater than the sheet transfer reference level ("YES" at S115), the controller 107 determines that the recording sheet 15 has passed the path 104 where the light detection unit 200 is provided, and the operation proceeds to S116.

At S116, the controller 107 determines whether the printing job is completed. When it is determined that the printing job is not completed ("NO" at S116), the operation returns to S108 to perform printing operation. When it is determined that the printing job is completed ("YES" at S116), the operation ends.

Referring now to FIG. 8, operation of controlling switching of the operation mode of the image forming apparatus 1 from the waiting mode to the energy save mode, performed by the controller 107, is explained according to an example embodiment of the present invention. The operation of FIG. 8 is performed when the operation mode is switched from the printing mode to the waiting mode.

At S201, the controller 107 determines that the operation mode is switched from the printing mode to the waiting mode, and causes the operation panel 112 to turn off the backlight of the LCD.

At S202, the controller 107 determines whether the image forming apparatus 1 is set to automatically switch to the energy save mode based on the detected light intensity. In this example, the controller 107 refers to the option indicating whether to automatically switch to the energy save mode based on the detected light intensity level, stored in the set value memory 109. As described above, the option may be set by the user through the operation panel 112 functioning as the set value input 110.

When the option stored in the set value memory 109 indicates that the option of automatically switching to the energy save mode is valid, the operation proceeds to S203. When the option stored in the set value memory 109 indicates that the option of automatically switching to the energy save mode is invalid, the operation proceeds to S208.

At S203, the controller 107 determines whether a user instruction for printing is received. When it is determined that the user instruction for printing is not received ("NO" at S203), the operation proceeds to S204. When it is determined that the user instruction for printing is received ("YES" at S203), the operation ends to switch the operation mode from the waiting mode to the printing mode. In the printing mode, the image forming apparatus 1 performs operation of FIG. 7.

At S204, the light sensor 201 detects the light intensity level of the light to determine whether to switch the operation mode to the energy save mode.

At S205, the light sensor 201 determines whether the light intensity level detected at S204 is less than the energy save reference level. When it is determined that the light intensity level is equal to or greater than the energy save reference level ("NO" at S205), the operation proceeds to S203 to determine that the operation mode is not switched to the energy save mode, and further determine whether a user instruction for printing is received.

When it is determined that the light intensity level is less than the energy save reference level ("YES" at S205), the controller 107 determines to switch to the energy save mode, and the operation proceeds to S206.

At S206, the controller 107 causes the timer 108 to start counting a time period to output a timer value. Further, at S206, the controller 107 determines whether the timer value reaches a second reference timer value. When it is determined that the timer value reaches the second reference timer value ("YES" at S206), the operation proceeds to S207 to switch the operation mode to the energy save mode. In the energy save mode, the controller 107 stops electric supply to a heater of the fixing device 18 to reduce energy consumption. When it is determined that the timer value does not reach the second reference timer value ("NO" at S206), the operation returns to S203.

At S208, the controller 107 determines whether a user instruction for printing is received. When the user instruction for printing is not received ("NO" at S208), the operation repeats S208. When the user instruction for printing is received ("YES" at S208), the operation ends to switch from the energy save mode to the printing mode.

As described above, even when the light detection unit 200 having the function of detecting a jam and the function of detecting ambient light is used, the image forming apparatus 1 is able to control operation of detecting a jam when performing image forming operation and to control switching of the operation mode from the waiting mode to the energy save mode, while suppressing an error in detection that may be caused by the light detection unit 200 having the function of detection a jam and detecting ambient light.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, involatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

For example, the discharge sheet tray 113 is provided at the top surface of the image forming apparatus 1 as illustrated in FIG. 1. Alternatively, the discharge sheet tray 113 may be provided at a position different from the top surface of the image forming apparatus 1.

Further, the image forming apparatus 1 may be additionally provided with any other device such as a scanner, an automatic document feeder (ADF), a post-processing device, etc. Further, the image forming apparatus 1 may be additionally provided with a function of communicating facsimile data, communicating data through a network, storing data, etc. Further, in this example, the image forming apparatus 1 is provided with a fixing device having a fixing heater. Alternatively, as long as the image forming apparatus 1 operates in the energy save mode, the image forming apparatus 1 may have a structure different from the one illustrated in FIG. 1. Further, in addition to or in alternative to stopping electric supply to the fixing device in the energy save mode, the image forming apparatus 1 may be caused to stop electric supply to any other device provided in the image forming apparatus 1 such as the image forming unit 2.

In one example, the present invention may reside in an image forming apparatus including: irradiating means for irradiating light to output irradiated light; receiving means for receiving light, the light including ambient light received from the outside of the image forming apparatus and the irradiated light received from the irradiating means; detecting means for detecting a light intensity level of the light received by the receiving means; preventing means for preventing or suppressing the receiving means from receiving the light when a recording sheet passes through a sheet transfer path; and controlling means for controlling at least two operations including: 1) operation of detecting a jam of the recording sheet in the sheet transfer path based on the light intensity level detected by the detecting means when image forming is performed; and 2) operation of controlling switching of an operation mode of the image forming apparatus to an energy save mode based on the light intensity level detected by the detecting means.

For example, the irradiating means may be implemented by a backlight of a display of an operation panel. The receiving means and the detecting means may be implemented by a light sensor, which is provided at a sheet transfer path between a fixing device and a sheet discharge roller pair. The preventing means may be implemented by a filler provided at the sheet transfer path and having a section that covers the receiving means of the light sensor when the recording sheet passes through the sheet transfer path. The controlling means may be implemented by a controller, such as a processor.

In the above-described example, the image forming apparatus is provided with a memory that stores a first reference level and a second reference level. When the light intensity level detected by the detecting means is less than the first reference level, the controlling means determines that the recording sheet is passing through the sheet transfer path. When the light intensity level detected by the detecting means is less than the second reference level, the controlling means increases a light intensity level of the irradiated light. The second reference level is set to be greater than the first reference level.

The controlling means may gradually increase the light intensity level of the irradiated light until the light intensity level detected by the detecting means reaches the second reference level or a maximum level.

When the light intensity level of the irradiated light reaches the second reference level, the controlling means starts image forming operation. In image forming operation, the controlling means counts a time period to obtain a timer value, determines whether the timer value reaches a first reference timer value, and determines that the jam of the recording sheet is detected when the light intensity level detected by the detecting means is less than the first reference level after the timer value reaches the first reference timer value.

When the light intensity level of the irradiated light reaches the maximum level, the controlling means determines that an error is detected in the receiving means when the light intensity level detected by the detecting means is still less than the second reference level, and notifies a user of the error detection.

When the image forming operation is successfully completed, the controlling means causes the operation of the image forming apparatus to switch from the printing mode to the waiting mode. In the waiting mode, the image forming apparatus turns off the irradiated light of the irradiating means.

In the above-described example, the controlling means causes the operation mode of the image forming apparatus to switch the energy save mode when the light intensity level detected by the detecting means is less than a third reference level.

The image forming apparatus may be additionally provided with means for setting an option to indicate whether to automatically switch to the energy save mode based on the detected light intensity level. For example, the means for setting may be implemented by an operation panel. The controlling means performs operation of controlling switching of the operation mode of the image forming apparatus to the energy save mode when the option indicates to automatically switch. The option is stored in a memory of the image forming apparatus such as NVRAM.

The image forming apparatus further includes means for changing the third reference level according to a user instruction. For example, the means for changing the third reference level may be implemented by an operation panel.

In one example, the present invention may reside in an image forming apparatus provided with a light detection unit having a function of jam detection and a function of detecting ambient light. The light detection unit includes a light sensor and a filler. The light sensor may be implemented by a light sensor of photointerrupter type, and is provided with a surface functioning as a light receive. The filler functions as a preventer that prevents or suppresses the light receive surface of the light sensor from receiving light. Using this light detection unit, a controller of the image forming apparatus is able to control operation of detecting a jam and operation of switching of the operation mode to the energy save mode.

In one example, the present invention may reside in a method of controlling an image forming apparatus. The image forming apparatus includes: irradiating means for irradiating light to output irradiated light; receiving means for receiving light, the light including ambient light received from the outside of the image forming apparatus and the irradiated light received from the irradiating means; detecting means for detecting a light intensity level of the light received by the receiving means; preventing means for preventing or suppressing the receiving means from receiving the light when a recording sheet passes through a sheet transfer path; and controlling means for controlling at least two operations including: 1) operation of detecting a jam of the recording sheet in the sheet transfer path based on the light intensity level detected by the detecting means when image forming is performed; and 2) operation of controlling switching of an operation mode of the image forming apparatus to an energy save mode based on the light intensity level detected by the detecting means. The method includes: obtaining a first reference level and a second reference level; determining whether the light intensity level detected by the detecting means is less than the second reference level; increasing a light intensity level of the irradiated light when the light intensity level detected by the detecting means is less than the second reference level; and starting image forming operation when the light intensity level detected by the detecting means reaches the second reference level.

The method may further include: determining that the recording sheet is passing through the sheet transfer path when the light intensity level detected by the detecting means is less than the first reference level.

The method may further include: obtaining a third reference level; and causing the operation mode of the image forming apparatus to switch to the energy save mode when the light intensity level detected by the detecting means is less than a third reference level.

In another example, the present invention may reside in a computer program that causes a processor to perform any one of the above-described methods of controlling the image forming apparatus.

In another example, the present invention may reside in a recording medium storing the computer program that causes the processor to perform any one of the above-described methods of controlling the image forming apparatus.

In another example, the present invention may reside in an image forming system including an image forming apparatus and a controller apparatus that are connected through a network. The image forming apparatus includes: irradiating means for irradiating light to output irradiated light; receiving means for receiving light, the light including ambient light received from the outside of the image forming apparatus and the irradiated light received from the irradiating means; detecting means for detecting a light intensity level of the light received by the receiving means; and preventing means for preventing or suppressing the receiving means from receiving the light when a recording sheet passes through a sheet transfer path. The controller apparatus controls at least two operations including: 1) operation of detecting a jam of the recording sheet in the sheet transfer path based on the light intensity level detected by the detecting means when image forming is performed; and 2) operation of controlling switching of an operation mode of the image forming apparatus to an energy save mode based on the light intensity level detected by the detecting means.

What is claimed is:

1. An image forming apparatus, comprising:

irradiating means for irradiating light to output irradiated light;

receiving means for receiving light, the light including ambient light received from the outside of the image forming apparatus and the irradiated light received from the irradiating means;

detecting means for detecting a light intensity level of the light received by the receiving means;

preventing means for preventing or suppressing the receiving means from receiving the light when a recording sheet passes through a sheet transfer path; and controlling means for controlling at least two operations including: 1) operation of detecting a jam of the recording sheet in the sheet transfer path based on the light intensity level detected by the detecting means when image forming is performed; and 2) operation of controlling switching of an operation mode of the image forming apparatus to an energy save mode based on the light intensity level detected by the detecting means, wherein the controlling means determines that the recording sheet is passing through the sheet transfer path when the light intensity level detected by the detecting means is less than a first reference level, wherein the controlling means causes the irradiating means to increase a light intensity level of the irradiated light when the light intensity level detected by the detecting means is less than a second reference level, and wherein the controlling means includes means for gradually increasing the light intensity level of the irradiated light until the light intensity level detected by the detecting means reaches the second reference level or a maximum level.

2. The image forming apparatus of claim 1, wherein, when the light intensity level of the irradiated light reaches the maximum level, the controlling means includes:

means for determining that an error is detected in the receiving means when the light intensity level detected by the detecting means is less than the second reference level; and means for notifying a user of the error detection.

3. The image forming apparatus of claim 1, wherein the controlling means causes the operation mode of the image forming apparatus to switch to the energy save mode when the light intensity level detected by the detecting means is less than a third reference level.

4. The image forming apparatus of claim 3, further comprising:

means for setting an option to indicate whether to automatically switch to the energy save mode based on the detected light intensity level, wherein the controlling means performs operation of controlling switching of the operation mode of the image forming apparatus to the energy save mode when the option indicates to automatically switch.

5. The image forming apparatus of claim 4, further comprising:

means for changing the third reference level according to a user instruction.

6. An image forming apparatus of claim 1, wherein the irradiating means is a backlight of a display of an operation panel.

7. The image forming apparatus of claim 6, wherein the receiving means and the detecting means are a light sensor, which is located at a position near the operation panel so as to receive the ambient light from the outside of the image forming apparatus and the irradiated light from the backlight.

8. The image forming apparatus of claim 7, wherein the preventing means is a filler provided at the sheet transfer path, the filler including:

a cover section; and a shaft section operably connected to the cover section to cause the cover section to cover at least a portion of the light sensor when the recording sheet presses the shaft section.

9. The image forming apparatus of claim 8, further comprising:

means for allowing the ambient light to enter into the receiving means, wherein the means for allowing is provided at a surface of the image forming apparatus where the operation panel is provided.

10. A method of controlling an image forming apparatus, the image forming apparatus includes:

irradiating means for irradiating light to output irradiated light;

receiving means for receiving light, the light including ambient light received from the outside of the image forming apparatus and the irradiated light received from the irradiating means;

detecting means for detecting a light intensity level of the light received by the receiving means;

preventing means for preventing or suppressing the receiving means from receiving the light when a recording sheet passes through a sheet transfer path; and controlling means for controlling at least two operations including: 1) operation of detecting a jam of the recording sheet in the sheet transfer path based on the light intensity level detected by the detecting means when image forming is performed; and 2) operation of controlling switching of an operation mode of the image forming apparatus to an energy save mode based on the light intensity level detected by the detecting means, the method comprising:

obtaining a first reference level and a second reference level;

determining whether the light intensity level detected by the detecting means is less than the second reference level;

increasing a light intensity level of the irradiated light when the light intensity level detected by the detecting means is less than the second reference level;

starting image forming operation when the light intensity level detected by the detecting means reaches the second reference level;

determining that the recording sheet is passing through the sheet transfer path when the light intensity level detected by the detecting means is less than the first reference level;

gradually increasing the light intensity level of the irradiated light until the light intensity level detected by the detecting means reaches the second reference level or a maximum level, wherein, when the light intensity level of the irradiated light reaches the maximum level, determining that an error is detected in the receiving means when the light intensity level detected by the detecting means is less than the second reference level; and notifying a user of the error detection.

11. The method of claim 10, further comprising:

obtaining a third reference level; and causing the operation mode of the image forming apparatus to switch to the energy save mode when the light intensity level detected by the detecting means is less than the third reference level.

12. The method of claim 11, further comprising:

providing a means for setting an option to indicate whether to automatically switch to the energy save mode based on the detected light intensity level, wherein, when the option indicates to automatically switch, the controlling means performs operation of controlling switching of the operation mode of the image forming apparatus to the energy save mode.

13. The method of claim 10, wherein the irradiating means is a backlight of a display of an operation panel.

14. The method of claim 13, wherein the receiving means and the detecting means are a light sensor positioned near the operation panel so as to receive the ambient light from the outside of the image forming apparatus and the irradiated light from the backlight.

15. The method of claim 14, wherein the preventing means is a filler provided at the sheet transfer path, the filler including:

a cover section; and a shaft section operably connected to the cover section and causing the cover section to cover at least a portion of the light sensor when the recording sheet presses the shaft section.

16. The method of claim 15, further comprising:

providing, at a surface of the image forming apparatus where the operation panel is provided, a means for allowing the ambient light to enter into the receiving means.

* * * * *